US006598876B1

(12) United States Patent
Pierce et al.

(10) Patent No.: US 6,598,876 B1
(45) Date of Patent: Jul. 29, 2003

(54) INTERACTIVE BOARD GAME WITH A TANGIBLE REWARD

(76) Inventors: Joseph Alexander Pierce, 4134 Deepwood La., Toledo, OH (US) 43614; James Matthew Bolone, 4148 Deepwood La., Toledo, OH (US) 43614

( * ) Notice: Subject to any disclaimer, the term of this patent is extended or adjusted under 35 U.S.C. 154(b) by 0 days.

(21) Appl. No.: 09/918,178

(22) Filed: Jul. 30, 2001

Related U.S. Application Data

(60) Provisional application No. 60/279,045, filed on Mar. 28, 2001, and provisional application No. 60/223,618, filed on Aug. 7, 2000.

(51) Int. Cl.[7] ..... A63F 7/02

(52) U.S. Cl. ..... 273/118 R; 273/119 R; 273/121 R; 273/122 R

(58) Field of Search ..... 273/118, 119, 273/121, 122, 440, 459, 126

(56) References Cited

U.S. PATENT DOCUMENTS 4,480,833 A * 11/1984 Barcelow et al. ..... 273/108.56
5,064,196 A * 11/1991 Gottlieb ..... 273/110
5,368,300 A * 11/1994 Becker ..... 273/119 R
5,722,656 A * 3/1998 Dickerson ..... 273/118 R
5,884,911 A * 3/1999 Guridi ..... 273/109
5,931,465 A * 8/1999 Miyake et al. ..... 273/108.1
5,988,637 A * 11/1999 Dickerson ..... 273/118 R
6,062,560 A * 5/2000 Peterson ..... 194/350
6,209,868 B1 * 4/2001 Norton ..... 273/118 R

FOREIGN PATENT DOCUMENTS

FR 2591010 * 6/1987 ..... 273/121 R

* cited by examiner

*Primary Examiner*—Raleigh W. Chiu

(57) ABSTRACT

The non-mechanical, manually operated combination board game and attached dispenser of gumballs or play balls which is played with paddle control rods uniquely placed over the top of the game, is designed for two or more players to simultaneously compete for the play ball prize which is emitted from the enclosed casing after one of the players successfully strikes the game ball into his goal, usually a hole at the opposite end of the play board.

1 Claim, 1 Drawing Sheet

INTERACTIVE BOARD GAME WITH A TANGIBLE REWARD

CROSS-REFERENCE TO RELATED APPLICATIONS

This petition for a non-provisional patent for The Interactive Board Game with a Tangible Reward is the same invention filed previously as a Patent Pending on Aug. 7, 2000 and assigned Ser. No. 60/223,618. Also reference herein is made to Patent Pending Ser. No. 60/279,045 filed on Mar. 28, 2001.

The Interactive Board Game with a Tangible Reward has a few, but certainly not all elements in common with applications Ser. Nos. 09/130,097 and 09/238/787. These are also games, but are neither made nor used in the same way as the patent being claimed herewith.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Statement of the Field of Endeavor

The present invention relates to interactive board games and also to candy/gumball dispensers for providing enjoyment and rewards to the participant(s).

2. Description of Information

The use of board games is known in the prior art, and so is the use of candy dispensers. More specifically, board games and candy dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,065,750 and U.S. Pat. No. 5,799,941.

While these devices fulfill their respective, particular objectives and requirements, the aforementioned patents do not disclose a new board game for one or more participants that rewards the participants with a prize (gumball or game ball) which emerges from the game board furniture after they successfully overcome their opponent and complete the game.

In prior art only one person could play and receive a gumball, jawbreaker or toy after inserting a coin into a machine; but he/she could not enjoy the interaction of a competitive game with another person. Also only one player could participate in some games. Several players could participate in other games which contained complicated mazes with a plurality of groves, columns, vertical extensions, barriers, starting spaces and loss of turn spaces. In addition, there were several elements with games but these games did not dispense the game ball to the winner. The elements with which the games were played remained with the game (dice, pins, etc.).

The Interactive Board Game with a Tangible Reward departs from these conventional concepts providing one or more players with an uncomplicated game that is challenging and rewarding, not just by winning the game, but also by dispensing the actual gameball, be it a gumball, jawbreaker or inedible ball (or ball equivalent) to the winner of the game.

BRIEF SUMMARY OF THE INVENTION

In view of the foregoing disadvantages inherent in the known types of board games, candy and gumball dispensers now present in the prior art, the present invention provides a new board game construction wherein the same can be utilized for providing an enjoying and challenging/interactive game for more than one player at the same time and will also reward the winner with the game ball used.

The general purpose of the invention, which will be described subsequently in greater detail, is to provide a new board game apparatus and method which has many of the advantages of the board games mentioned heretofore but also incorporates advantages of the standard gumball/game ball machines; plus it provides novel features that result in a new board game which is not anticipated, rendered obvious, suggested, or even implied by any of the prior art board games.

The ball or other tangible body (ball equivalent which is to be moved over the game board) is usually initially put into motion after a coin has been put into an attachment which is affixed to a container filled with gumballs, basketballs, soccer balls, etc. The ball or other object is released onto the game floor after the proper coin has been inserted. The ball then continues in motion under its own inertia following the laws of gravity.

The floorboard is slightly raised in the center to provide equally descending slopes toward each participant's manipulative instrument. In the provided embodiment of the invention, the board slant, manipulative instruments, game winning holes are shown for two participants. However, it is to be understood that the invention is not limited to the details of construction and arrangement of the components set forth in the following description or illustrated in the drawings.

The invention is capable of other embodiments and of being practiced and carried out in various ways. Therefore the abstract is neither intended to define the invention of the application nor is it intended to be limiting as to the scope of the invention in any way.

The participant(s) manually manipulate instruments (sticks, clubs, holders, etc.) to strike, impel, launch or project the game projectile over the playing surface such as a game board, using skill, luck, and dexterity to guide the object into the hole, hoop, area, etc. which is designated as the winning area.

The players have no waiting for one another, do not have to reposition the middle board, nor be concerned about losing game pieces because the game is enclosed.

They do not have to worry about moving a certain number of spaces nor loss of turn areas.

The participants use their instruments also to deflect the game ball to prevent it from going into the goal each is defending. When one of the players succeeds in hitting the game ball over the floorboard, bypassing his/her opponent's defense, and knocking the game ball into the goal which is usually a hole in the game board, the participant wins the game. The projectile used in the game is then expelled outside the enclosed casing once the object of the game/sport has been attained, thus rewarding the winner.

The housing for the game could be made of a one-piece molded material or constructed of individual parts fastened together as shown in the preferred embodiment. The housing could be made out of any suitable material.

Thus has been outlined the more important features of the invention in order that the detailed description that follows may be better understood. There are additional features of the invention that will be described herein. It is to be understood that the phraseology and terminology employed herein are for the purpose of description and should not be regarded as limiting.

As such those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application.

It is therefore an object of the present invention to provide a new board game and method which has many of the advantages of other board games and candy and gumball dispensers in a novel way which is not anticipated, rendered obvious, suggested, or even implied by any of the prior art board games, either alone or in any combination thereof.

It is also the object of the present invention to provide a new board game which may be easily and efficiently manufactured and marketed.

It is also the object of the present invention to provide a new board game which is of a durable and reliable construction.

BRIEF DESCRIPTION OF THE DRAWING

This invention will be better understood when consideration is given to the following detailed description and to the annexed drawing which shows the overall view of this invention. Because the invention could be placed on a countertop just as well as being affixed, bonded, welded, etc. to a base, a base is not pictured. Also, the inventors are not claiming invention of a gumball or game vending machine, so the sphere for holding the gumballs, game balls, etc. it not pictured Nor are the inventors claiming to invent a coin acceptor, so this device is not pictured.

Each component used in this game is labeled on the drawing and described on an accompanying sheet.

DETAILED DESCRIPTION OF THE INVENTION

Figure 1:
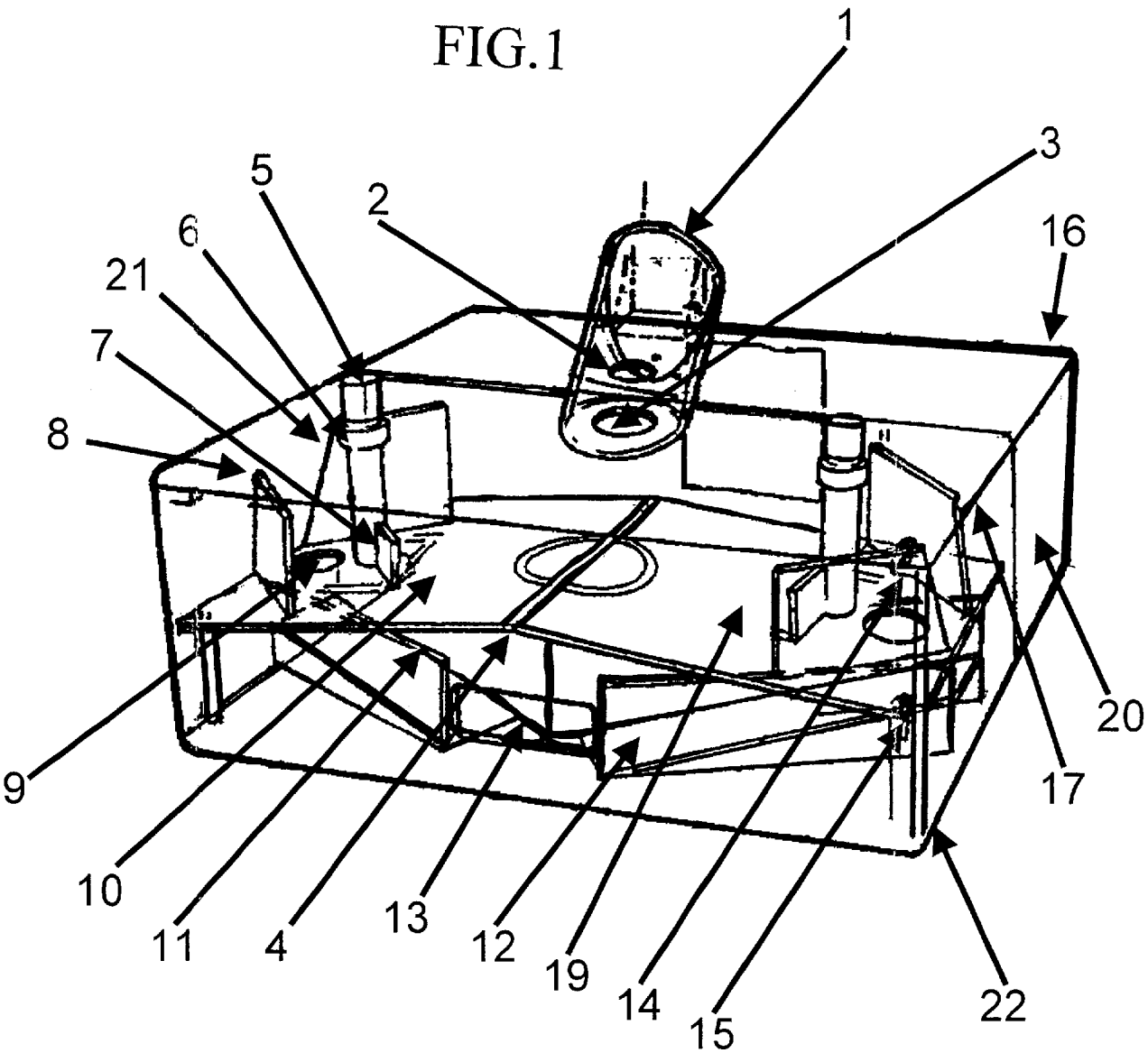
FIG. 1 shows the overall view of this invention.

The invention is an apparatus for amusement, recreation, play/skill game/sport in which one or more players or participants use a ball, gumball, jawbreaker, or other such tangible body which occupies physical space and can be impelled, propelled, projected, or otherwise put into motion so as to achieve an objective for the particular game/sport and wherein the result of playing such a game/sport is indicated by the winning competitor receiving the game ball or object which emerges from the game board furniture when the object of the game has been attained.

Devices which are ancillary or appurtenant to manipulating the object are dictated by the particular game/sport in which the participants are engaged. These devices are movable and/or rotatable and are manually used by the participants to come in contact with the object being used (soccer ball, gumball, etc.) to achieve the end result of the game/sport.

The ball or other tangible body (ball equivalent which is to be moved over game board) is usually initially put into motion and released on to the game floor after a coin has been put into a coin acceptor which is attached to a sphere filled with gumballs, basketballs, etc. This is attached to the game board. The ball or other object continues in motion under its own inertia following the laws of gravity.

The game floor is slightly raised in the center to provide equally descending slopes toward each participant's manipulative instrument.

The participants physically manipulate instruments (sticks, clubs, holders, etc.) to strike, impel, launch or project the game projectile over the playing surface such as a game board, using skill, luck, and dexterity to guide the object into the hole, hoop, area, etc.

The game board is enclosed so that the game ball or object is unattainable until the object of the game or sport has been achieved. The manually controlled elements which the participants use are designed to enable each player to improve or perfect his or her physical skills (e.g. motor skills, coordination, etc.)

The game board is a middle board interposed between the base member and the top member. It is enclosed and is the playing area defined by the design on the floor board and pockets, hoops or holes. The participants use their instruments (swingable, rotatable, etc.) to strike/place the ball or object with the ball-striking portion using physical speed and dexterity attempting to outdo their opponent.

The design on the floor board of the game/sport and the ball/ball equivalent are dictated by the particular game/sport. When the floor board is designed (stamped, printed, painted or otherwise designated on the surface area) as a hockey rink, a hockey puck is used and the game is called SLAP SHOT. When the floor board is designed as a soccor field, a miniature soccor ball is used and the game is called SHOOT OUT. Additionally points could be designated on the floor board to give added incentive to participants to win the game.

The game board has a separated section used as a receptacle for the coins which are inserted into an attached play ball, gumball, etc. machine which contains the objects used as the game ball, etc. for the game/sport. The projectile (game ball) used in the game is expelled outside the enclosed casing once the object of the game/sport has been attained, thus rewarding the winner.

The process of making the invention is begun by taking a petroleum base and forming the members of the invention.

The drain tube 1 guides the ball or ball equivalent exiting from the holding chamber to drop onto the game play floor surface 4 where the game is actually played.

The coin access hole 2 leads into the coin chamber box. The hole provides relief should excess coins build up in the actual mechanism coin housing.

The ball drop hole 3 is where the ball exits for play after it is channeled by the drain tube.

The play paddle control rod 5 is used to control the movement of the play paddle face 7.

The play paddle stabilizer collar 6 governs the placement and upward and downward movement of the play paddle. This keeps the play paddle in a controlled vertical position while allowing it to be twisted 360 degrees for play.

The play paddle face 7 is the surface that actually connects with the ball and propels it as a result of the twisting force of the play paddle control rod 5.

The corner deflector shield 8 covers the corners of the game so as to provide the play paddle appropriate and controlled ball contact.

The drain hole 9 allows the ball to drain into it after the goal has been obtained and the ball proceeds into the further drain process.

The inner sub drain floor cross piece and ball guide 10 supports the play floor from the bottom, and supports the control paddle while also acting as the inner ball drain travel guide.

The outer sub play floor ball drain travel guide 11 controls the drained ball toward the final drain hole.

The drain ramp 12 exists for the exiting ball to drop onto and be expedited to the final drain opening 13.

The final drain opening 13 provides access to the ball at its post drain final resting state.

The top cover mounting screw 14 mounts the protective cover onto the front game shell 17. The front game shell 17 houses the actual game floor, the game pieces, play, and overall game.

The play floor mounting screw 15 mounts and secures the play floor to the front game shell 17.

The rear game shell 16 houses the coin chamber and the top of which is the mounting area for the coin mechanism.

The front game shell 17 houses the actual game floor, game pieces, play, and overall game.

The coin chamber access door 18 provides access to the area where the relief coin build up occurs.

The front game shell 19 houses the actual game as does the top 17, the rear 16 and the sides 20 and 21.

With respect to the above description, it is to be considered illustrative only of the principals of the invention. Since numerous modifications and changes will readily occur to those skilled in the art, it is not desired to limit the invention to the exact construction and operation shown and described; accordingly, all suitable modifications and equivalents may be resorted to falling within the scope of the invention, such as having the floor in a cone shape to allow equal opportunity if goals/winning spots and playing paddles/instruments be provided for more than two players.

Other modifications for this interactive gumball/play ball game include having a tiltable game board within the game housing and having participants use extending levers to manipulate gumball/game piece over the game board to arrive at the designated goal in order to win the game and be rewarded with the gumball/game piece.

We claim:

1. A gumball game comprising:

a game floor surface, said game floor surface having a drain hole at opposite ends thereof;

a ball drop hole located above the game floor surface and through which a gumball can be introduced for play;

a play paddle at each end of the game floor surface used to guard said drain holes;

said play paddle connected to a play paddle control rod, said control rod including at least one stabilizer collar, said collar used to govern the placement and vertical movement of said play paddles; and, an inner sub drain floor cross piece and ball guide located below said game floor surface and used to both support said game floor surface and serve as a ball drain travel guide.

* * * * *